US008727477B2

(12) United States Patent
Kosaka et al.

(10) Patent No.: US 8,727,477 B2
(45) Date of Patent: May 20, 2014

(54) INK-JET PRINTING APPARATUS AND INK STAIN DETECTION METHOD IN THE SAME

(75) Inventors: Kei Kosaka, Tokyo (JP); Yoshiaki Murayama, Tokyo (JP); Satoshi Azuma, Kawasaki (JP); Makoto Torigoe, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 93 days.

(21) Appl. No.: 13/524,214

(22) Filed: Jun. 15, 2012

(65) Prior Publication Data

US 2013/0010025 A1 Jan. 10, 2013

(30) Foreign Application Priority Data

Jul. 4, 2011 (JP) ..... 2011-148157

(51) Int. Cl.
*B41J 29/393* (2006.01)

(52) U.S. Cl.
USPC ..... 347/19

(58) Field of Classification Search
USPC ..... 347/16, 19, 104, 105
See application file for complete search history.

(56) References Cited

U.S. PATENT DOCUMENTS 5,650,804 A * 7/1997 Kawamura et al. ..... 347/19
7,396,112 B2 * 7/2008 Sanada ..... 347/68
2011/0279832 A1 11/2011 Muro et al.

FOREIGN PATENT DOCUMENTS

JP 2008-55839 A 3/2008

* cited by examiner

*Primary Examiner* — Lamson Nguyen
(74) *Attorney, Agent, or Firm* — Fitzpatrick, Cella, Harper & Scinto

(57) ABSTRACT

An apparatus includes a printing unit configured to eject ink from a print head onto a sheet conveyed in a direction to perform printing on the sheet; a conveying unit configured to be provided on a downstream side of the print head in the direction, and configured to include a rotating member in contact with the sheet; and a reading unit configured to read a surface of the sheet on a downstream side of the rotating member in the direction, in which information on ink adhesion to the rotating member is obtained based on a result read by the reading unit.

11 Claims, 15 Drawing Sheets

| | INK COLOR TO BE TRANSFERRED | VALUE USED FOR DETERMINATION | TRANSFER DETERMINATION CONDITIONS |
|---|---|---|---|
| ROLLER POSITION a | M | G VALUE | MINIMUM VALUE IN ANALYSIS REGION IS NOT MORE THAN 200 |
| ROLLER POSITION b | Y | B VALUE | MINIMUM VALUE IN ANALYSIS REGION IS NOT MORE THAN 200 |
| ROLLER POSITION c | Y | B VALUE | MINIMUM VALUE IN ANALYSIS REGION IS NOT MORE THAN 200 |

FIG.5

| | VALUE USED FOR DETERMINATION | TRANSFER DETERMINATION CONDITIONS |
|---|---|---|
| ROLLER POSITION a | MINIMUM VALUE OF (R, G, B) VALUES | MINIMUM VALUE IN ANALYSIS REGION IS NOT MORE THAN 200 |
| ROLLER POSITION b | MINIMUM VALUE OF (R, G, B) VALUES | MINIMUM VALUE IN ANALYSIS REGION IS NOT MORE THAN 200 |
| ROLLER POSITION c | MINIMUM VALUE OF (R, G, B) VALUES | MINIMUM VALUE IN ANALYSIS REGION IS NOT MORE THAN 200 |

FIG.14

INK-JET PRINTING APPARATUS AND INK STAIN DETECTION METHOD IN THE SAME

BACKGROUND OF THE INVENTION

1. Field of the Invention

The present invention relates to an ink-jet printing apparatus which can detect ink stain, and to a detection method of the ink stain.

2. Description of the Related Art

In an ink-jet printing apparatus which ejects ink to perform printing, there have been known problems in which ink stain caused on a sheet transfers to a component member of a sheet conveying mechanism of the printing apparatus, or in which the transferred ink stain furthermore retransfers to the subsequent sheet.

As for the reduction of such an ink stain, Japanese Patent Laid-Open No. 2008-055839 describes that in a sheet conveying direction, a sheet conveying unit of a downstream side of a print head is provided at a position which does not overlap with a pressing unit, thereby preventing ink stain from retransferring to a sheet from the pressing unit.

SUMMARY OF THE INVENTION

However, in an ink-jet printing apparatus, printing regions by a plurality of print heads overlap with each other due to an error of a conveying amount, or the like, which causes ink overflow that cannot be absorbed by a sheet, and the ink overflow maybe ink stain. In addition, an ink ejection amount is increased due to temperature rise of the print head, which may cause ink overflow. Such an ink stain adheres to a conveying roller or the like, and it may furthermore retransfer to the sheet (hereinafter this phenomenon is also referred to as "roller transfer"). With a configuration of retransfer prevention in Japanese Patent Laid-Open No. 2008-055839, retransfer of the ink stain to the sheet due to the above-mentioned causes cannot be prevented. Furthermore, it is difficult to previously detect such an ink stain, and when printing is continued while the ink stain has not been detected, sheets continue to be stained with ink, and thus wasted paper trash and ink consumption may be caused.

An object of the present invention is to provide an ink-jet printing apparatus and a method for the same which can detect an ink stain which may be caused in a conveying roller or a sheet and prevent it and which can further reduce amounts of sheets and ink wasted due to the ink stain.

An apparatus of the present invention for solving the above-described problem, including:

a printing unit configured to eject ink from a print head onto a sheet conveyed in a conveying direction, to perform printing on the sheet;

a conveying unit configured to be provided on a downstream side of the print head in the conveying direction, and configured to include a rotating member in contact with the sheet; and a reading unit configured to read a surface of the sheet on a downstream side of the rotating member in the conveying direction, in which information on ink adhesion to the rotating member is obtained based on a result read by the reading unit.

Even when ink overflow is caused from the sheet during image printing, the overflowed ink adheres to the conveying roller, and is further transferred to the sheet, the apparatus can detect the transfer and can inspect the sheet stained by the transfer. Furthermore, since printing is not continued in a state of causing transfer, amounts of wasted paper trash and ink consumption can be reduced.

Further features of the present invention will become apparent from the following description of exemplary embodiments (with reference to the attached drawings).

BRIEF DESCRIPTION OF THE DRAWINGS

FIG. 5 is a table showing transfer determination RGB values of the first embodiment;

FIG. 14 is a table showing transfer determination RGB values of the second embodiment.

DESCRIPTION OF THE EMBODIMENTS

Hereinafter, preferred embodiments of the present invention will be explained with reference to accompanying drawings.

(First Embodiment)

Figure 1:
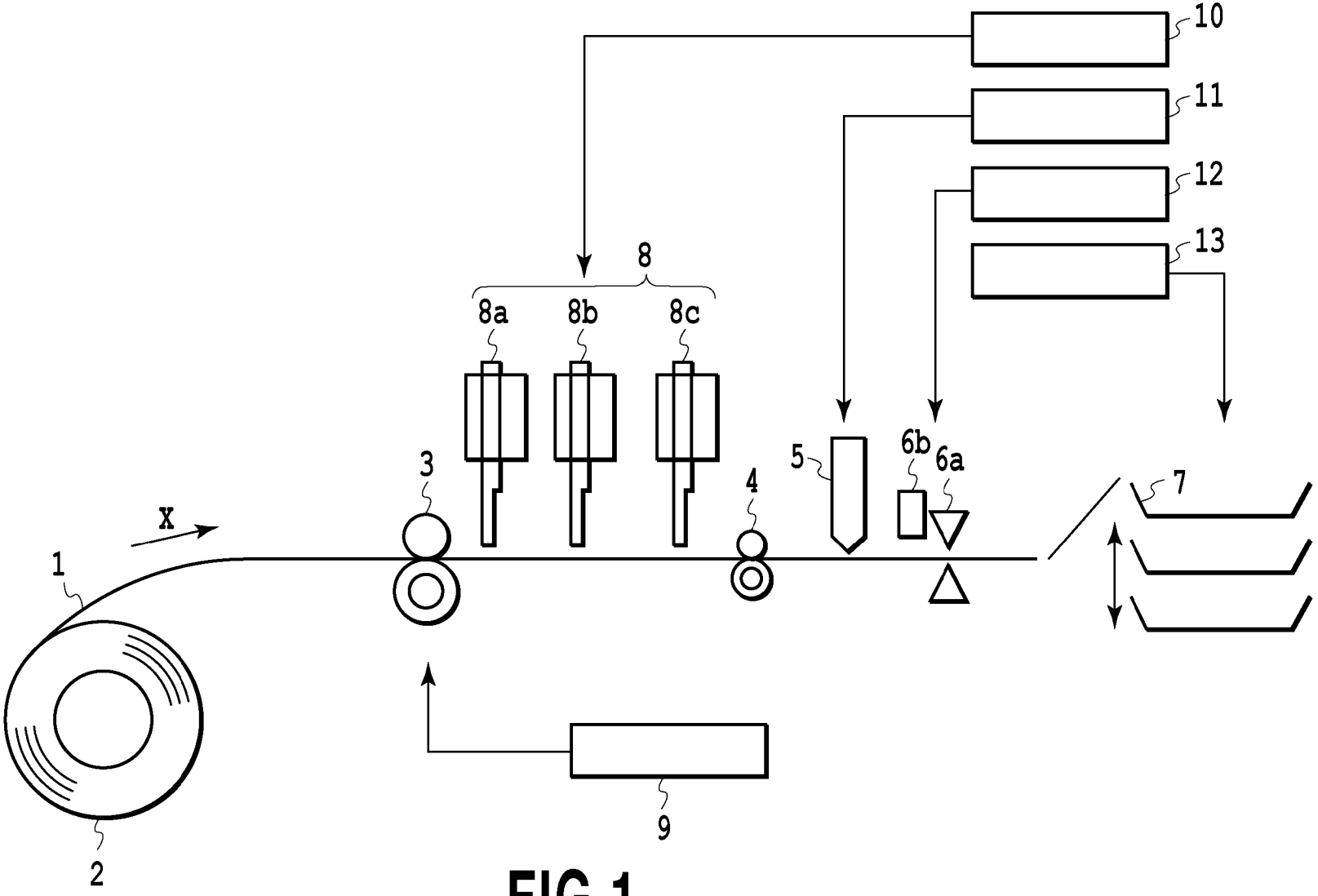
FIG. 1 is a diagram showing a configuration of an ink-jet printing apparatus of a first embodiment.
Figure 2:
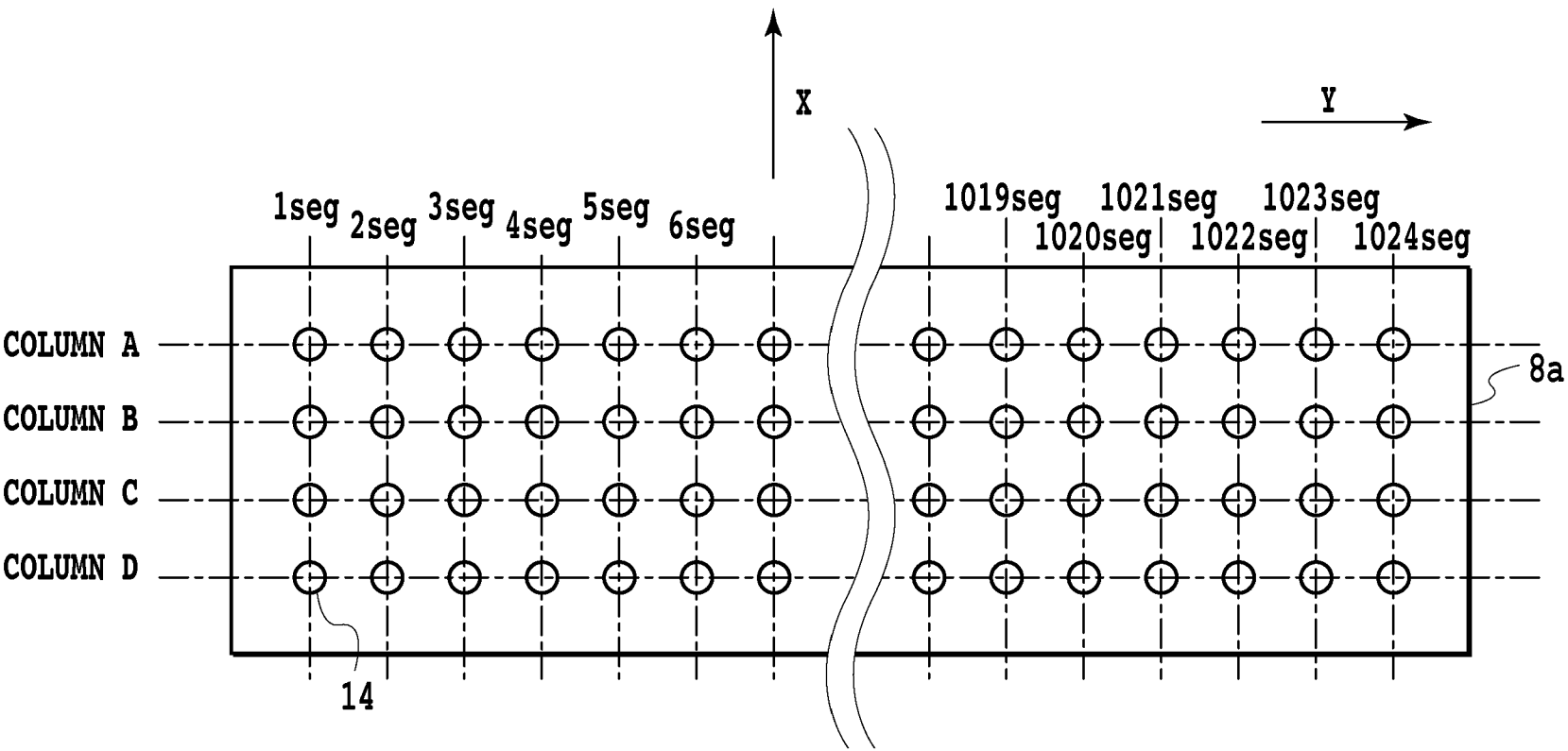
FIG. 2 is a diagram showing a nozzle alignment on an ink ejection surface of a print head of the first embodiment.

With reference to FIGS. 1 and 2, there will be described an ink-jet printing apparatus and a print head used therefore of a first embodiment of the present invention.

FIG. 1 is a diagram showing a configuration of the ink-jet printing apparatus of the present embodiment. The ink-jet printing apparatus of the present embodiment is provided with a sheet cassette 2, conveying rollers 3 and 4, a scanner 5, a cutter 6*a*, a cut mark sensor 6*b*, a sorter 7, and a print head 8. In addition, the ink-jet printing apparatus of the present embodiment is provided with, as control sections, a conveyance control section 9, a print head control section 10, a scanner control section 11, a cutter control section 12, and a sorter control section 13. Hereinafter, a conveying direction of a sheet is referred to as an X direction, and a direction perpendicular to the X direction is referred to as a Y direction. First, a sheet 1 is held in between by the conveying rollers 3 and 4 which are rotating members configuring a conveying mechanism, and is conveyed by controlling the conveying rollers 3 and 4 by the conveyance control section 9 to rotate it. Along with the conveyance, ink is ejected to a predetermined region of the sheet 1 as a print medium from a nozzle of the print head 8 by the print head control section 10 based on ejection data for ejecting ink, and an image is printed. The print head 8 is a line head of a sheet width independent for each ink color, and three print heads 8*a*, 8*b*, and 8*c* are arranged in order of C (cyan), M (magenta), and Y (yellow) from an upstream side in the conveying direction of the sheet. A pattern printed on the conveyed sheet 1 can be read as an RGB value by causing the scanner 5 to operate by the scanner control section 11. Furthermore, the conveyed sheet 1 can be cut by causing the cutter 6*a* as a cutting section to operate by the cutter control section 12. A cutting operation is performed at a timing when a cut mark printed on the sheet is detected by the cut mark sensor 6*b*. Cut printed matters are stacked on the sorter 7. The sorter is provided with various trays such as a large-size tray, a small-size tray, a disposal tray, or the like in order to sort the printed matters depending on image size and use application, and the sorter control section can select to which tray a printed matter is taken out, thereby enabling the printed matters to be organized.

FIG. 2 is a diagram showing a nozzle alignment on an ink ejection surface of the print head of the present embodiment. In the present embodiment, orifices of a plurality of nozzles 14 are arranged in a matrix on the ink ejection surface of the print head 8*a* (cyan), and nozzle columns configured by the plurality of nozzle orifices aligned in a line are aligned in order of a column A, a column B, a column C, and a column D. A thousand and twenty-four nozzle orifices are aligned for each column, and the corresponding nozzle orifices of the each column are aligned in a line as shown with the same seg (segment) number in the drawing. A nozzle resolution indicates 1200 dpi. In the present embodiment, the print head 8*a* is installed in the ink-jet printing apparatus so that the nozzle columns of the column D to the column A are aligned in that order in the sheet conveying direction shown as the X direction with an arrow in FIG. 2. The other print heads 8*b* (magenta) and 8*c* (yellow) have configurations similar to the above.

A detection pattern of the first embodiment of the present invention will be described with reference to FIGS. 3 and 4.

Figure 3:
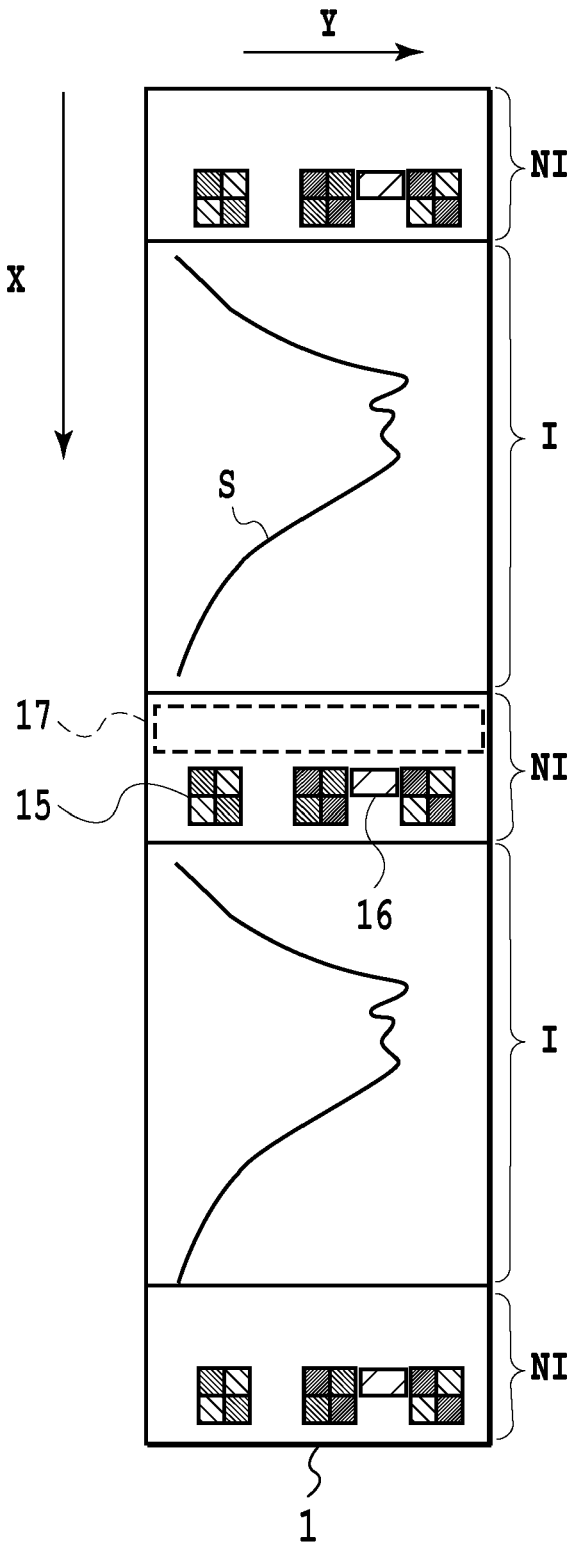
FIG. 3 is a schematic diagram of an image and a pattern printed on a sheet of the first embodiment.

FIG. 3 schematically shows an image and a pattern printed on a sheet of the present embodiment. In FIG. 3, a desired image S, a detection pattern 15, and a cut mark 16 are printed on the sheet 1. In the present embodiment, the detection pattern 15 and the cut mark 16 are printed on a non-image region NI between image regions I in which the desired image S has been printed. A margin for detecting transfer by a scanner is provided posterior to the detection pattern, and a region 17 including this margin region is read by the scanner 5.

Figure 4C:
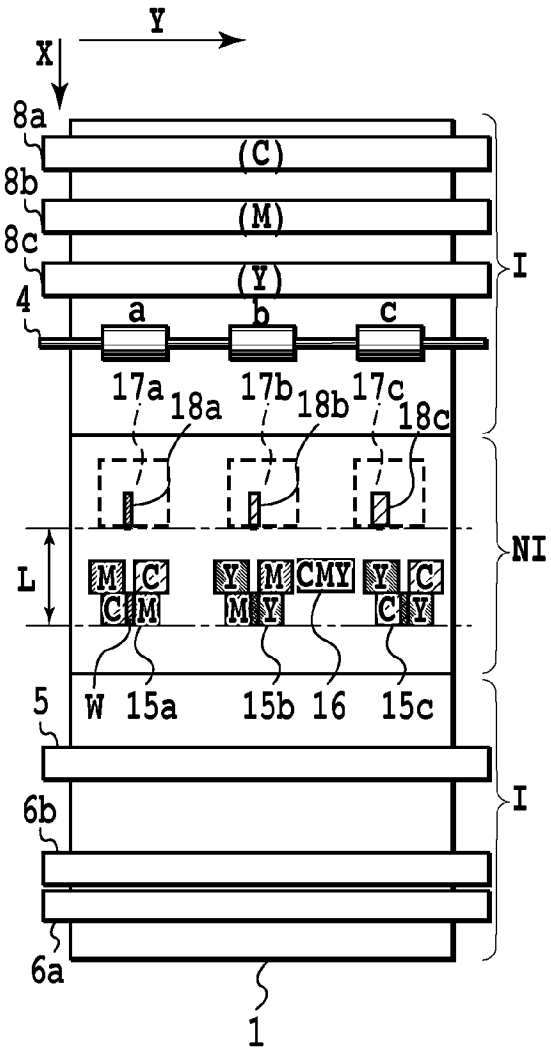
FIGS. 4A to 4C are detailed diagrams of patterns for detection and cut marks of the first embodiment.
Figure 4B:
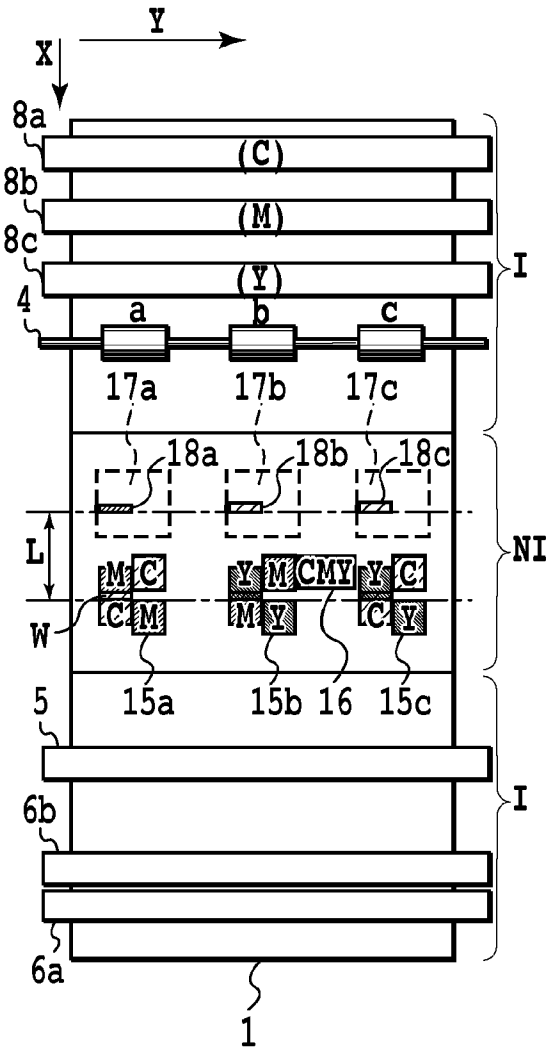
Figure 4A:
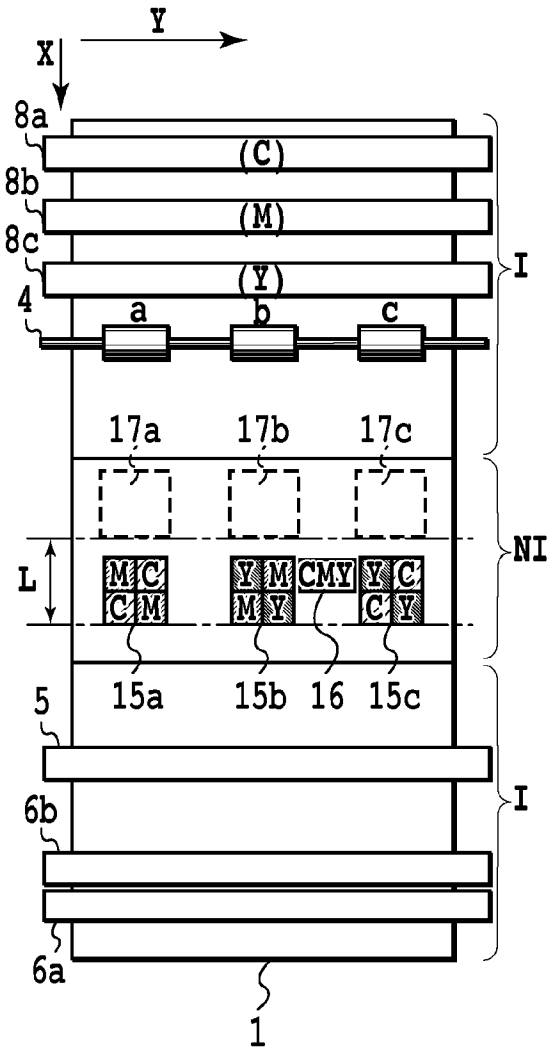

FIG. 4A shows a detailed diagram of the detection pattern and the cut mark of the present embodiment. The detection pattern 15 is the pattern in which solid patterns of different color inks are adjacent to one another in a zigzag manner, and it is printed only on positions corresponding to nip portions of the conveying roller 4. As a combination of the solid patterns of different color inks, on a position corresponding to a position a, a CM pattern 15*a* that is a combination of a cyan solid pattern and a magenta solid pattern is printed. Similarly, on a position corresponding to a position b, an MY pattern 15*b* that is a combination of the magenta solid pattern and a yellow solid pattern is printed, and on a position corresponding to a position c, a CY pattern 15*c* that is a combination of the cyan solid pattern and the yellow solid pattern is printed. These patterns are printed with a design maximum ink applying amount for each color. The "ink applying amount" herein is an ink weight to be ejected for a unit area of the sheet, and when an ejection amount of an ink droplet is constant, the "ink applying amount" can also be represented by replacing the ink weight with the number of droplets. In the region 17 (refer to FIG. 3) read by the scanner 5, used for analysis are regions 17*a*, 17*b*, and 17*c* which are located away from the pattern 15 in a −X direction (i.e., on the upstream side of the sheet conveying direction) by a circumferential length L of the conveying roller 4, and which correspond to positions of the nip portions of the conveying roller 4. In addition, the cut mark 16 is printed in three colors CMY. Although it is generally known that a density of a printed matter becomes higher as the ink applying amount is increased, an ink applying amount of the cut mark may just be the amount with which a print density enough to detect the cut mark by the cut mark sensor can be achieved. Here, the detection pattern 15 is configured with patterns 15*a*, 15*b*, and 15*c* as mentioned above, and is printed on positions corresponding to the nip portions of the conveying roller 4 in the non-image region NI. The cut mark 16 is arranged at a position different from the detection pattern 15 in the Y direction in the same region as the non-image region NI where the detection pattern 15 has been printed, and thus an entire length of the pattern printed on the region NI is shortened, thereby enabling the reduction of the amount of sheets which end up in paper trash.

FIG. 4B shows a detection pattern when ink overflow occurs when conveyance deviation in a +X direction occurs between print heads. In the present embodiment, the plurality of print heads and the plurality of nozzle columns of the each print head are arranged spaced away from each other in the sheet conveying direction. The "conveyance deviation" herein means position deviation of a printed image due to a sheet conveyance error which may be caused in a sheet being conveyed between the plurality of print heads and/or the plurality of nozzle columns which are arranged spaced away from each other. In the present embodiment, conveyance deviation occurs uniformly in the +X direction, and M is deviated from C in the X direction by +100 μm in the detection pattern 15*a*. Similarly, Y is deviated from M by +100 μm in the pattern 15*b*, and Y is deviated from C in the X direction by +200 μm in the pattern 15*c*. When the conveyance deviation between the print heads occurs, ink overflow occurs in a region W where the solid patterns of different color inks are overlappingly printed. Overflowed ink is conveyed with the sheet, adheres to a surface of the conveying roller located on a downstream side of the print head in the X direction, and is further transferred to the sheet. That is, in the present embodiment, stains 18*a*, 18*b*, and 18*c* due to ink overflow adhere to positions in the regions 17*a*, 17*b*, and 17*c*, respectively, which are away from a boundary position of the solid patterns of different color inks in the −X direction by the circumferential length L of the conveying roller 4. Since an overflowed ink color is the ink color placed temporally later, an M ink overflows in the CM pattern on the position corresponding to the position a, a Y ink overflows in the MY pattern on the position corresponding to the position b, and a Y ink overflows in the CY pattern on the position corresponding to the position c. Accordingly, a threshold value used for transfer determination can be decided corresponding to the patterns (positions of the nip portions of the conveying roller) as shown in FIG. 5. That is, a G value is set to be the threshold value corresponding to the M ink for the position a, and a B value is set to be the threshold value corresponding to the Y ink for the positions b and c. This threshold value is referred to as a transfer determination RGB value.

FIG. 4C shows a detection pattern when ink overflow occurs when conveyance deviation in a −Y direction perpendicular to the sheet conveying direction occurs between the print heads. Conveyance deviation arises uniformly in the −Y direction, and an amount of the deviation of M is −100 μm from C, that of Y is −100 μm from M, and that of Y is −200 μm from C. Also in this case, stains 18*a*, 18*b*, and 18*c* due to ink overflow adhere to positions in the regions 17*a*, 17*b*, and 17*c*, respectively, which are away from the boundary position of the solid patterns of different color inks in the −X direction by the circumferential length L of the conveying roller 4. Since an overflowed ink color is the ink color placed temporally later, the M ink overflows in the CM pattern on the position corresponding to the position a, the Y ink overflows in the MY pattern on the position corresponding to the position b, and the Y ink overflows in the CY pattern on the position corresponding to the position c. Accordingly, a threshold value used for transfer determination can be determined in the same way as in the above-mentioned FIG. 5.

In this way, since the solid patterns of different color inks are arranged in the zigzag manner in the detection pattern in the present embodiment, it is possible to detect roller transfer regardless of whether conveyance deviation between the print heads of each ink color arises in the ±X direction or in the ±Y direction.

Figure 6:
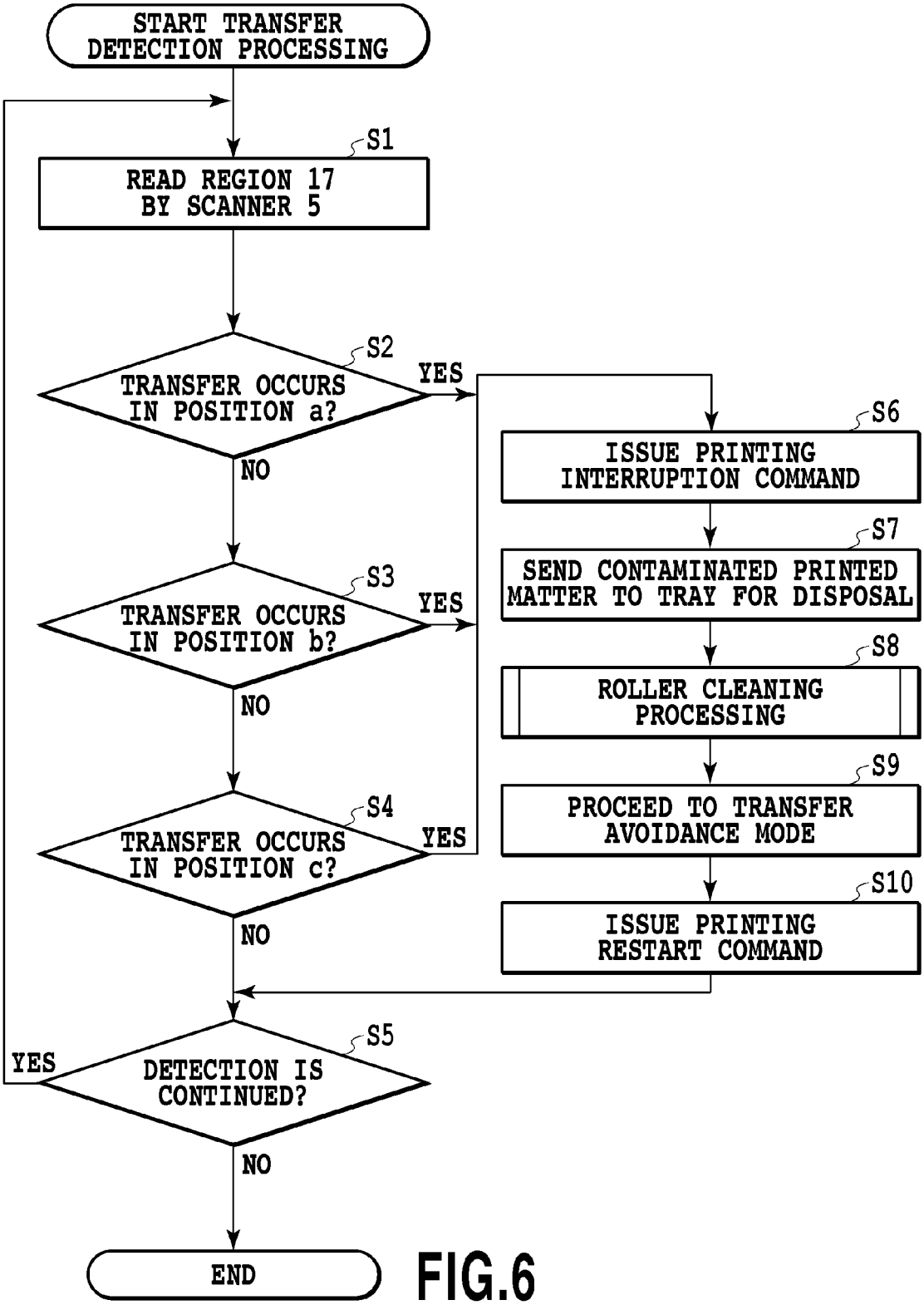
FIG. 6 is a flow chart showing a procedure of analysis processing of the detection pattern of the first embodiment.

FIG. 6 is a flow chart showing a procedure of analysis processing of the detection pattern aimed at detection of roller transfer. Hereinafter, details of the flow will be described.

First, the region 17 having moved from the detection pattern in the −X direction by the roller circumferential length is read by a scanner at a resolution of 400 dpi (step S1 in FIG. 6). In the read pattern, the regions 17*a*, 17*b*, and 17*c* corresponding to the positions a, b, and c of the nip portions of the conveying roller are analyzed by the scanner control section, and it is determined whether or not roller transfer occurs for each nip portion of the roller (steps S2, S3 and S4 in FIG. 6). As mentioned above, as for the RGB values used for determination, the G value is used for analysis of the position corresponding to the position a and the B value is used for analysis of the positions corresponding to the positions b and c.

Figure 7A:
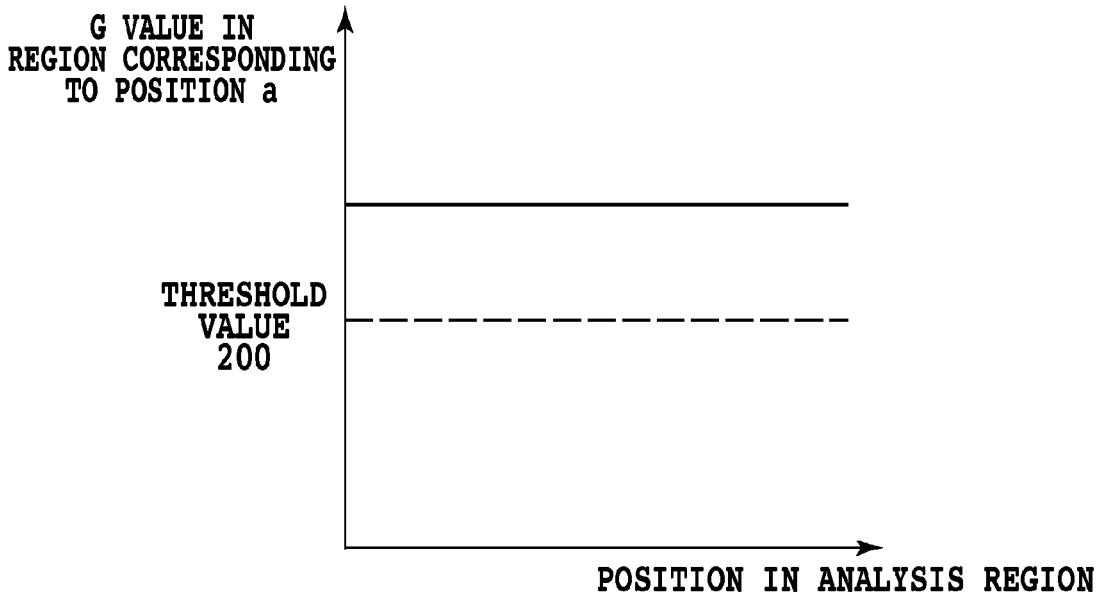
FIGS. 7A and 7B are graphs showing a detailed transfer determination method of the first embodiment.
Figure 7B:
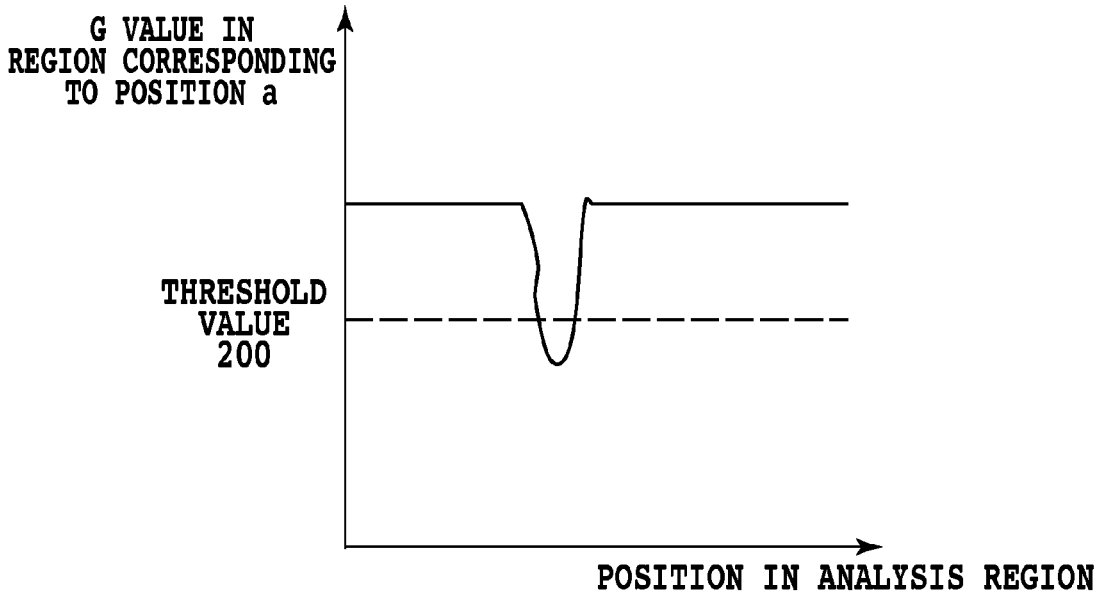

Here, a transfer determination method will be described with reference to FIGS. 7A and 7B. As shown in FIG. 7A, when a minimum value of the RGB values in an analysis region exceeds a transfer determination RGB value which is the threshold value for transfer determination, it is determined that the roller transfer has not occurred. As shown in FIG. 7B, when the minimum value of the RGB values in the analysis region is not more than the transfer determination RGB value, it is determined that the roller transfer has occurred. That is, information on ink adhesion (transfer) to the roller is obtained by detecting that ink caused to adhere (transfer) to the surface of the roller has been retransferred. Although the threshold value is set to be 200 in the drawing, the threshold value may be changed to an appropriate value depending on a type of sheet or an ink-jet printing apparatus body.

When it is determined that transfer has not occurred in all the nip portions of the roller, it is determined whether or not detection is further continued (step S5 in FIG. 6), and the program returns to step S1 when being continued, and transfer detection processing is finished when not being continued. Meanwhile, when it is determined in steps S2 to S4 that roller transfer has occurred in any one of the nip portions of the roller, a command for interrupting image printing is output (step S6 in FIG. 6). Subsequently, a printed matter which may be stained by the roller transfer is taken out to the disposal tray (step S7 in FIG. 6). Because of this, even if there is a stained printed matter by the roller transfer, it can be inspected and disposed of. Furthermore, since image printing is not continued in a state where the roller transfer has occurred, an amount of stained sheets as wasted paper trash and a consumption amount of ink can be reduced.

Figure 8:
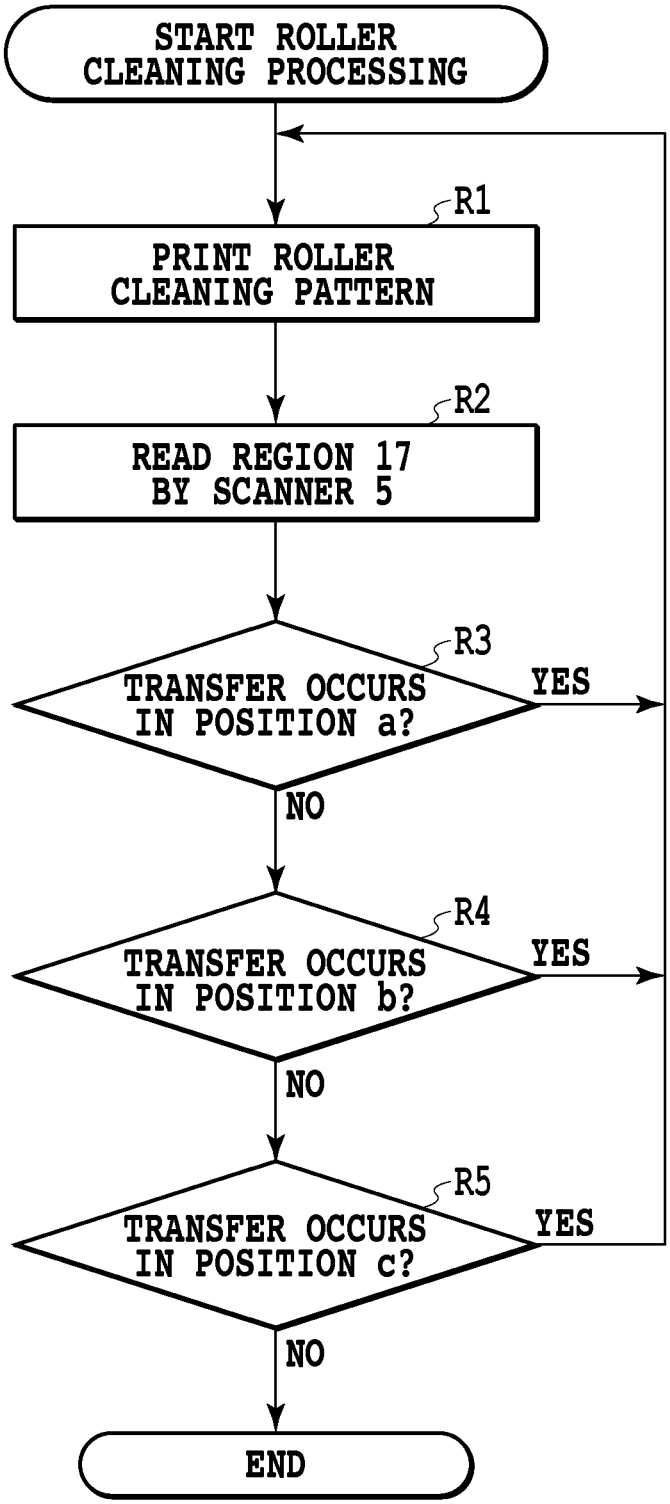
FIG. 8 is a flow chart showing a procedure of roller cleaning of the first embodiment.
Figure 9:
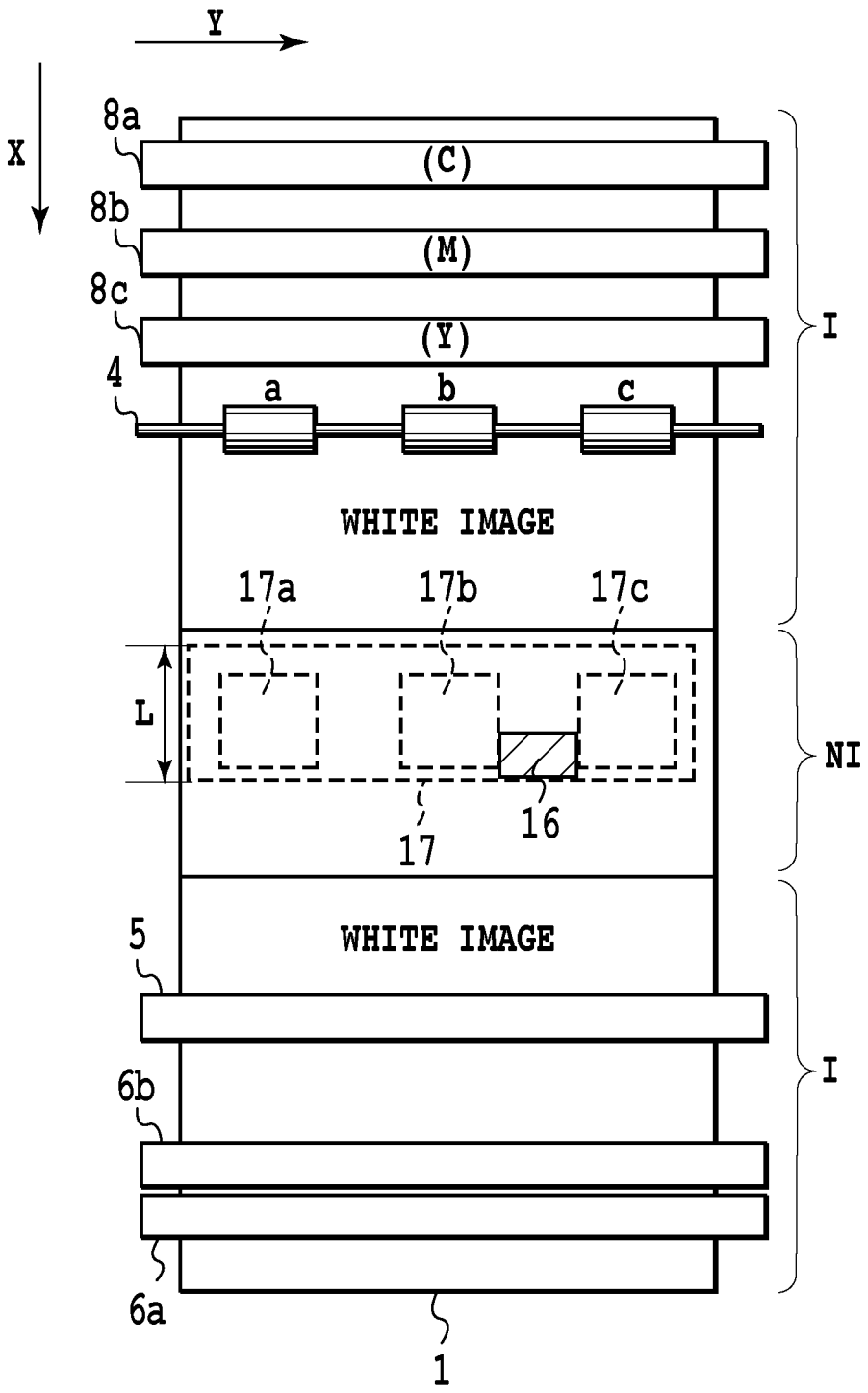
FIG. 9 is a diagram showing a pattern of the roller cleaning of the first embodiment.

Here, when the roller transfer is detected and printing is interrupted, the program proceeds to roller cleaning processing since a printed matter is stained if image printing is restarted while the conveying roller 4 has been stained with ink (step S8). The roller cleaning processing is performed by continuing printing operation without printing an image, for example, until ink stain having adhered to the conveying roller 4 becomes in a state of not retransferring to the sheet. A sequence of the roller cleaning processing is shown in FIG. 8. With reference to FIG. 8, first, a roller cleaning pattern is printed (step R1 in FIG. 8). The roller cleaning pattern is, as shown in FIG. 9, the pattern in which one white image to which ink is not ejected is printed in an image region of a sheet, and only a cut mark required for cutting is printed in a non-image region. After that, the region 17 is read by the scanner 5 (step R2 in FIG. 8), and it is confirmed whether or not stain of all the nip portions of the conveying roller has been removed, by reading the RGB values of the regions 17*a*, 17*b*, and 17*c* corresponding to the positions a, b, c of the nip portions of the roller (steps R3, R4 and R5 in FIG. 8). Determination of whether to be stained is determined according to determination conditions similar to transfer determination conditions shown in FIGS. 5, 7A, and 7B. When it is determined that stain of all the nip portions of the roller is removed, roller cleaning is finished. When it is determined that any one of the nip portions of the roller is stained, cleaning is performed again. Cleaning is continued until stain of the roller is removed.

Referring to FIG. 6 again, after the roller cleaning processing is executed, a print mode is changed so that the roller transfer does not occur again, and the program proceeds to a transfer avoidance mode in which an ink applying amount is reduced more than in a usual print mode (step S9 in FIG. 6). The ink applying amount of the transfer avoidance mode is set to be 0.8 times as much as that of the usual print mode. A unit configured to reduce an ink applying amount may be a method for reducing the dot number of an input image, or may be a method for reducing an ejection amount by changing driving conditions.

In the present embodiment, although a case has been described where the detection pattern is printed between each image, the detection pattern may be inserted at an interval of a plurality of images, or may be inserted at an arbitrary timing.

Although a configuration using a scanner as an image reading device is employed in the present embodiment, other image reading devices may be used.

(Second Embodiment)

Figure 10:
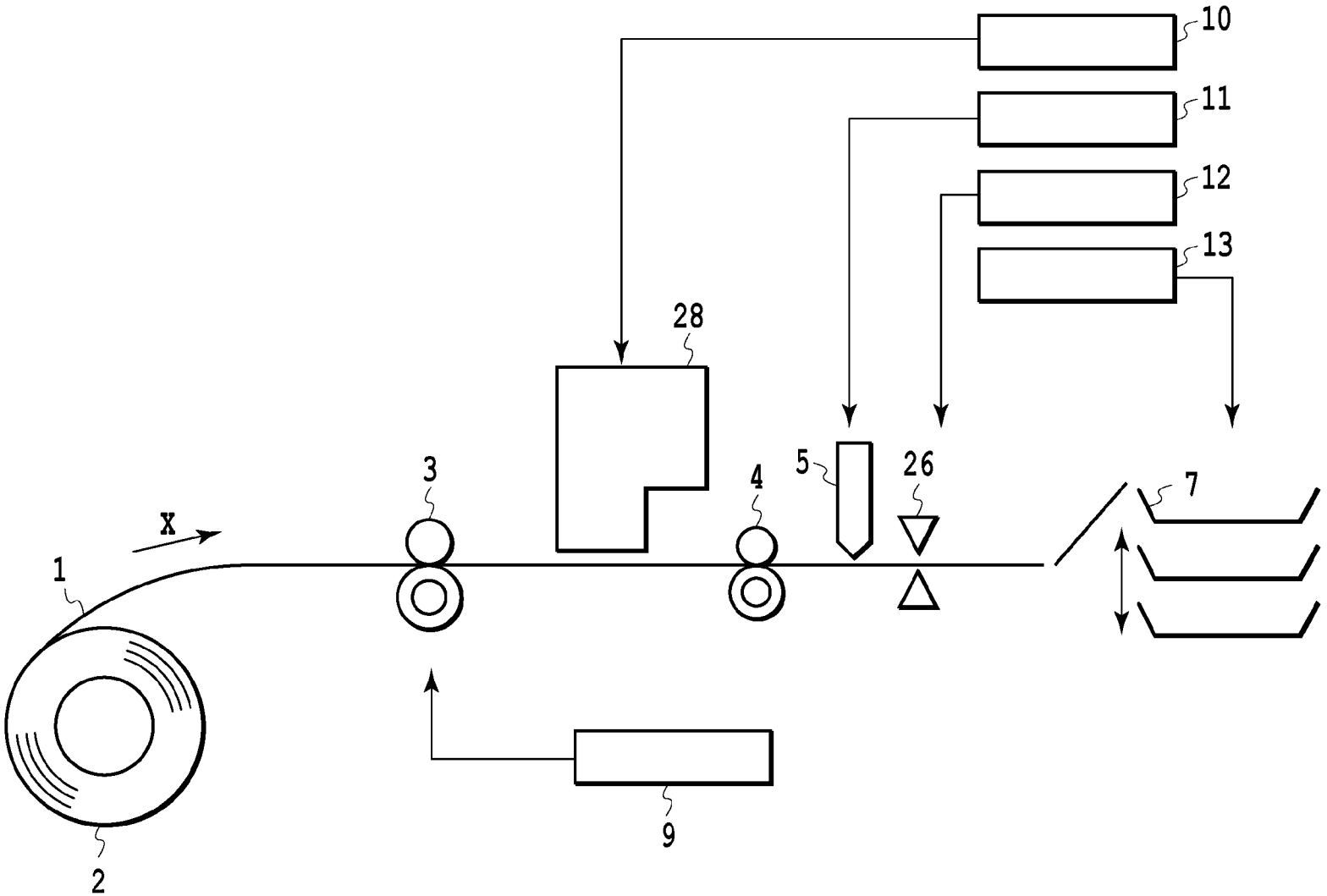
FIG. 10 is a diagram showing a configuration of an ink-jet printing apparatus of a second embodiment.
Figure 11:
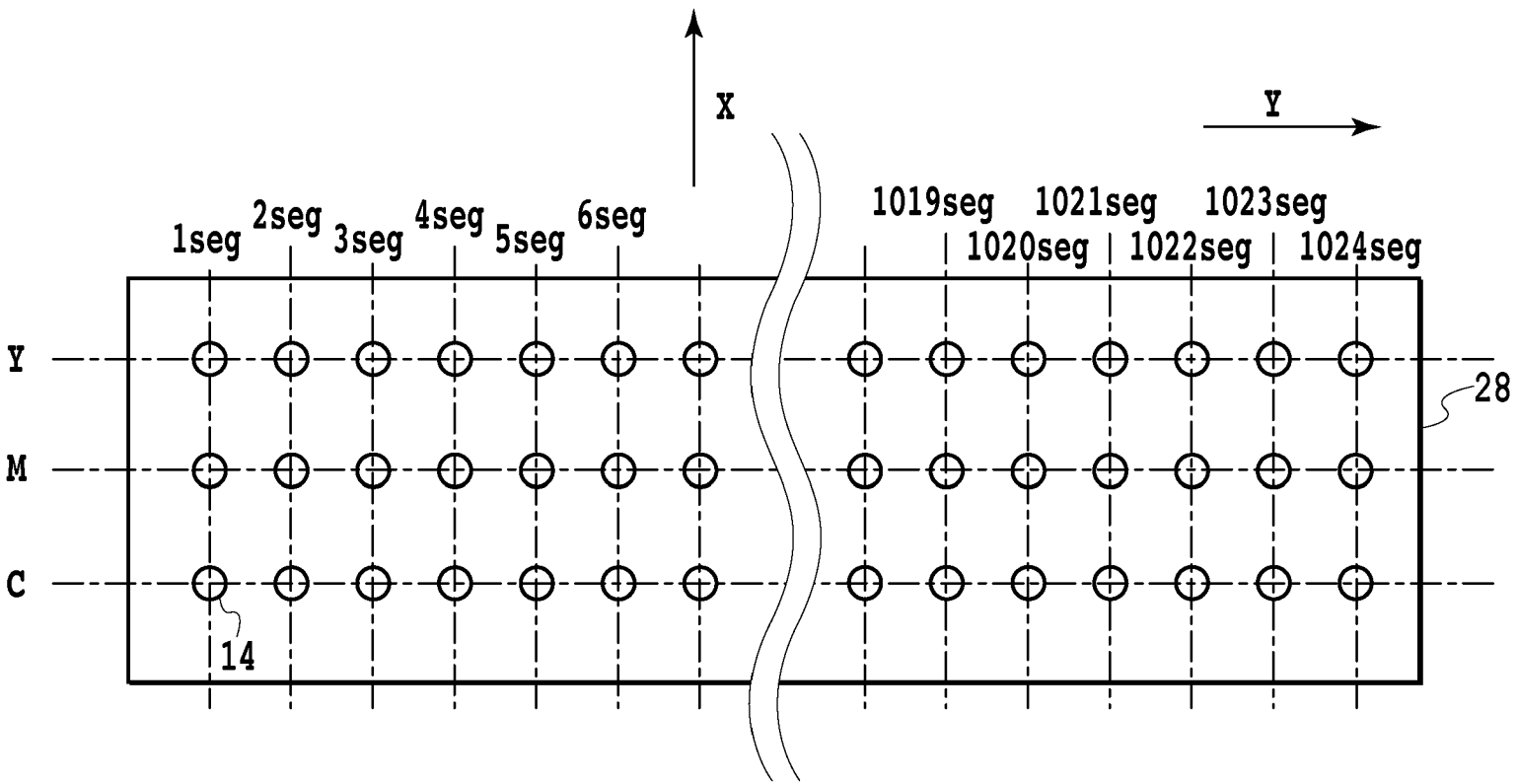
FIG. 11 is a diagram showing a nozzle alignment on an ink ejection surface of a print head of the second embodiment.

With reference to FIGS. 10 and 11, there will be described an ink-jet printing apparatus and a print head used therefor in a second embodiment of the present invention.

FIG. 10 is a diagram showing a configuration of the ink-jet printing apparatus of the present embodiment. In FIG. 10, configurations common to the configurations of the ink-jet printing apparatus of the first embodiment shown in FIG. 1 are indicated with the same symbols, and thus detailed description thereof will be omitted here. The ink-jet printing apparatus of the present embodiment comprises the cutter 26 for cutting a sheet similarly in the first embodiment, and the sheet 1 can be cut by causing the cutter 26 to operate by the cutter control section 12. In contrast, unlike the first embodiment, the cutter mark sensor (shown with a symbol 6*b* in FIG. 1) is not an essential component in the present embodiment, and a cutting operation can be executed based on a timing when a detection pattern printed on the sheet is detected by the scanner 5. In addition, whereas the print heads 8*a*, 8*b*, and 8*c* for each ink color are used in the first embodiment, a print head 28 of the present embodiment is a line head of a single sheet width having nozzle columns of three colors of ink CMY.

FIG. 11 is a diagram showing a nozzle alignment on an ink ejection surface of the print head of the present embodiment. Instead of four nozzle columns A to D which eject the same color ink in the print head of the first embodiment shown in FIG. 2, the print head of the present embodiment has three nozzle columns which eject three colors of ink CMY. That is, in the present embodiment, orifices of the plurality of nozzles 14 are arranged in a matrix on an ink ejection surface of the print head 28, and the nozzle columns in which the plurality of nozzle orifices are aligned in a line are aligned in order of C, M, and Y in terms of ink colors ejected from the nozzle orifices. A thousand and twenty-four nozzle orifices are aligned for each column, and the corresponding nozzle orifices of each column are aligned in a line as shown with a same seg (segment) number in the drawing. A nozzle resolution indicates 1200 dpi. In the present embodiment, the print heads 28 are installed in the ink-jet printing apparatus so that the nozzle columns of ink colors of C to Y are aligned in that order in the sheet conveying direction shown as the X direction with an arrow in FIG. 11.

Here, the detection pattern of the second embodiment of the present invention is the pattern which doubles as the cut mark, and it is also a preliminary ejection pattern for recovering a poor-ejection nozzle. That is, printing of the detection pattern doubles as a preliminary ejection operation. Hereinafter, the detection pattern will be described with reference to FIGS. 12 and 13.

Figure 12:
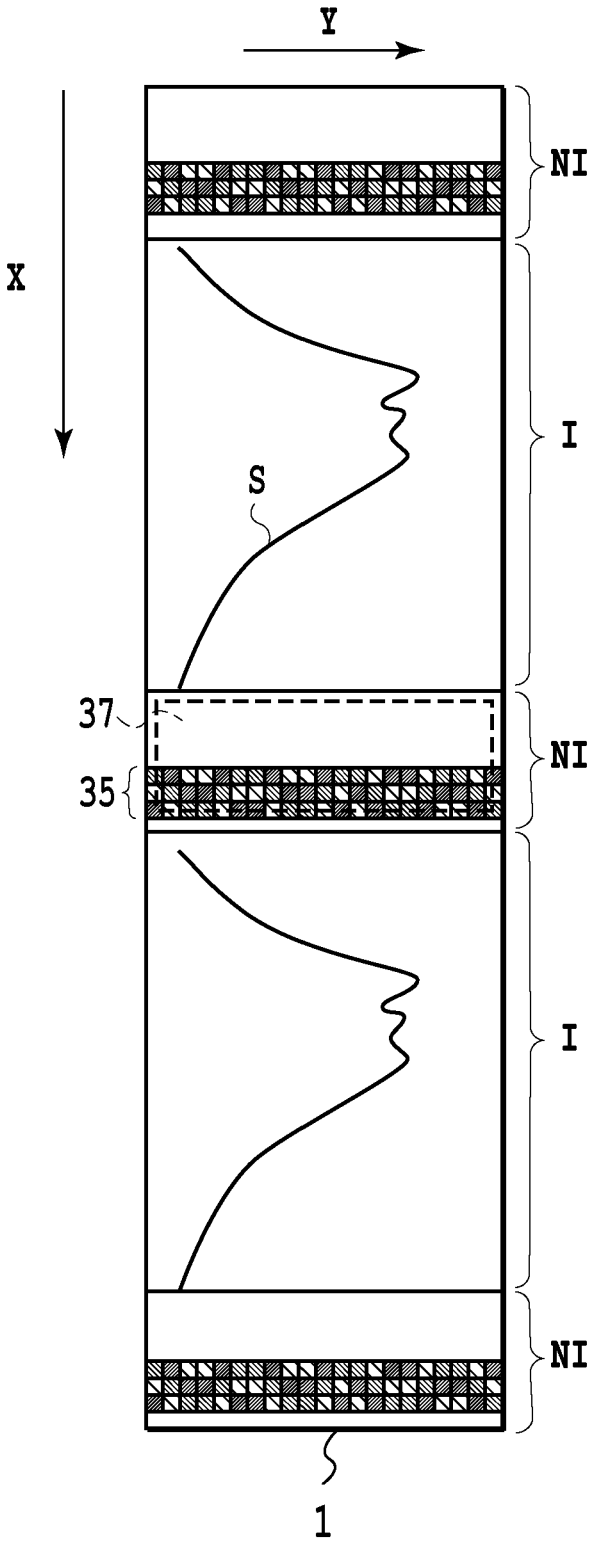
FIG. 12 is a schematic diagram of an image and a pattern printed on a sheet of the second embodiment.

FIG. 12 schematically shows an image and a pattern printed on a sheet of the present embodiment. In FIG. 12, the desired image S and a detection pattern 35 are printed on the sheet 1. In the present embodiment, the detection pattern 35 is printed on the non-image region NI between the image regions I in which the desired image S has been printed. Furthermore, a margin for detecting transfer with a scanner is provided posterior to the detection pattern. In the present embodiment, a region 37 including at least a part of the detection pattern 35 and a margin region provided posterior to the detection pattern 35 is read by the scanner 5.

Figure 13B:
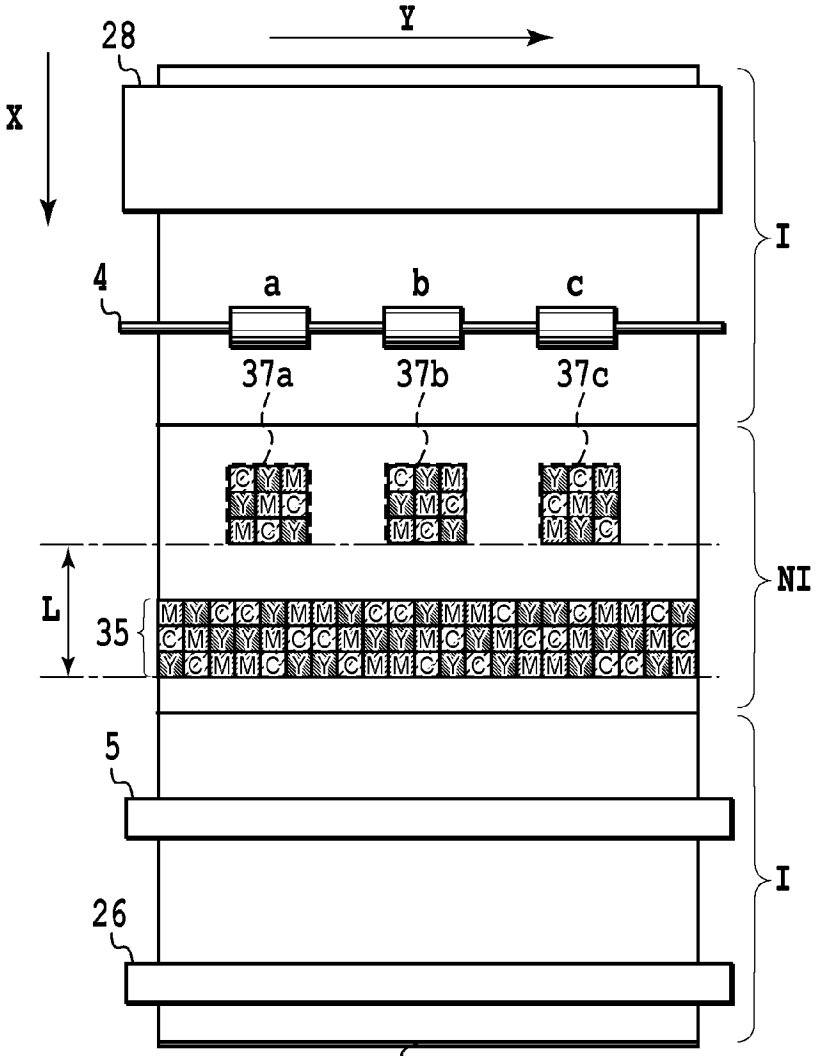
FIGS. 13A and 13B are detailed diagrams of patterns for detection of the second embodiment.
Figure 13A:
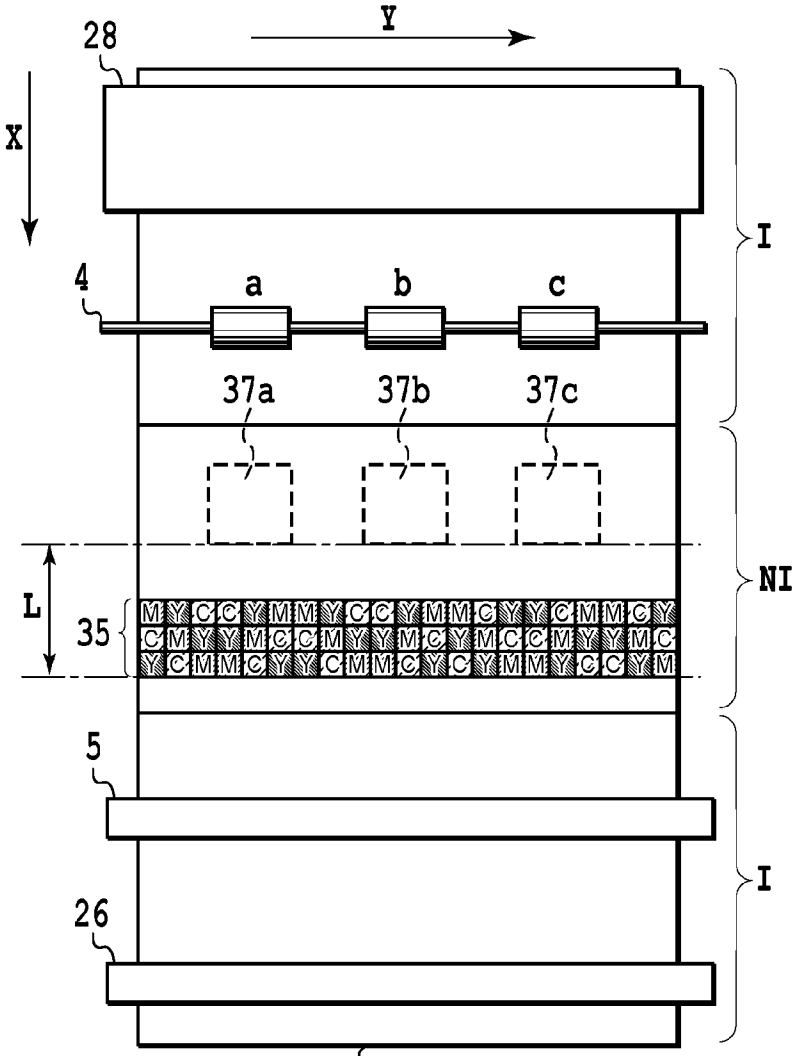

FIG. 13A shows a detailed diagram of the detection pattern of the present embodiment. The detection pattern 35 is the pattern in which solid patterns with different color inks are adjacent to one another in a zigzag manner, and it is printed with a design maximum ink applying amount for each color. Next, in the region 37 (refer to FIG. 12) read by the scanner 5, there are used, for analysis, regions 37*a*, 37*b*, and 37*c* which are located in a position having moved from the detection pattern 35 in the −X direction by the circumferential length L of the conveying roller 4, and which correspond to the positions of the nip portions of the conveying roller 4. In addition, in the present embodiment, the detection pattern 35 doubles as the cut mark, the region 37 is read with the scanner, and a sheet is cut based on a timing when the detection pattern 35 included in the region 37 is detected. The detection pattern 15 of the first embodiment is printed only on positions corresponding to the nip portions of the conveying roller 4 in a width direction (an arrow Y direction) of the sheet. In contrast to that, the detection pattern 35 of the present embodiment is printed on a full width of the sheet. Therefore, since the number of ink droplets sufficient for recovery can be ejected from all the nozzles of all the ink colors in printing of the detection pattern 35, this printing also plays a role of preliminary ejection (flushing) which discharges ink caused to firmly adhere to thereby eliminate ejection clogging.

FIG. 13B shows a detection pattern when ink overflow occurs on a sheet due to temperature rise of an entire print head. That is, when a temperature of the entire print head rises, ink ejection amounts of all the colors CMY increase more than a designed value, thereby causing ink overflow of the entire detection pattern 35 printed on the sheet. In the present embodiment, stain due to ink overflow adheres to the regions 37*a*, 37*b*, and 37*c*, respectively having moved from the detection pattern 35 in the −X direction by the circumferential length L of the conveying roller 4. If transfer occurs, the RGB values of the regions 37*a*, 37*b*, and 37*c* become values deviated from the RGB values in a state of no adhesion of ink stain, i.e., the RGB values of so-called white paper specific to the sheet 1. Consequently, as shown in FIG. 14, if a minimum value of the RGB values in an analysis region regarding each roller position is not more than a transfer determination RGB value which is a threshold value for transfer determination, it may just be determined that the roller transfer has occurred. Although the threshold value is set to be 200 in the drawing, the threshold value may be changed to an appropriate value depending on a type of sheet or an ink-jet printing apparatus body.

Figure 15:
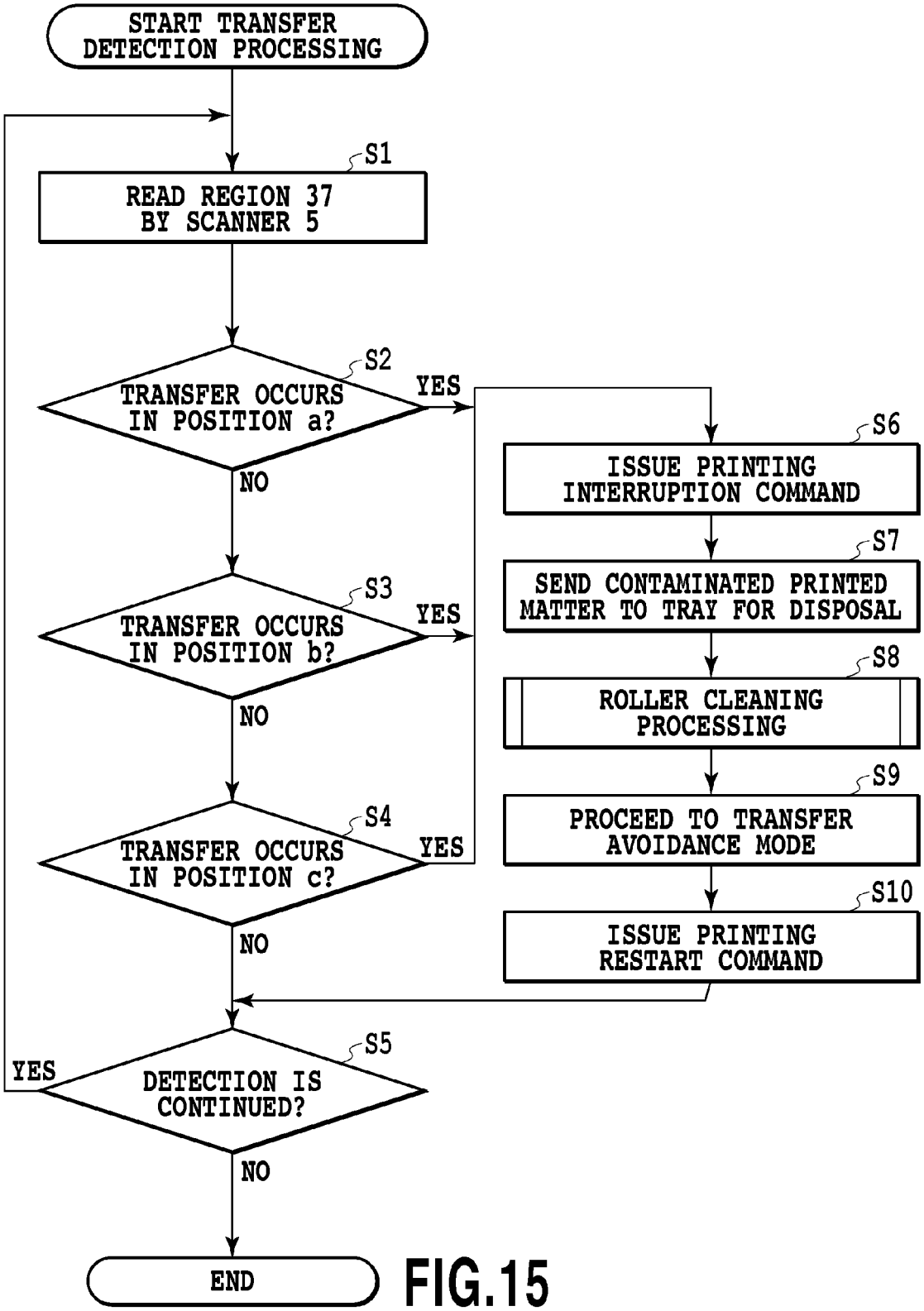
FIG. 15 is a flow chart showing a procedure of analysis processing of the detection pattern of the second embodiment.

An analysis procedure of the detection pattern aimed at detection of the roller transfer may be performed in a form as shown in FIG. 15 with a procedure similar to that in the first embodiment.

Although in the present embodiment, there has been shown a mode in which the rotating member conveying the sheet is a roller, the rotating member may be a belt-rotating member bridged between the plurality of rollers. When the conveying roller 4 is the belt-rotating member, it is detected that ink has adhered to a belt surface. Although a case has been described where the detection pattern is printed between each image in the present embodiment, the detection pattern may be inserted at an interval of a plurality of images, or may be inserted at an arbitrary timing.

Although a configuration using the scanner as the image reading device is employed in the present embodiment, other image reading devices maybe used. In addition, transfer determination has been performed based on the RGB value in the present embodiment, but the present invention is not limited to this, and transfer determination can be performed based on other optical densities. Accordingly, although a configuration using three colors of ink CMY is employed in the present embodiment, ink colors may not be limited to these, and a configuration using ink of black color, gray color, or the like may be employed.

Although a case of temperature rise has been given as a factor of ink overflow in the present embodiment, there can also be detected roller transfer due to other factors such as conveyance deviation between the nozzle columns of each ink color.

In this way, the present invention is the invention in which a detection pattern corresponding to a position of a conveying roller is printed on a non-image region and in which a region having moved from the pattern by a circumferential length of the conveying roller is read and analyzed by an image reading device, whereby roller transfer is detected. According to the present invention, it becomes possible to inspect a printed matter stained with ink by roller transfer, and to dispose of it. In addition, in the roller transfer being detected, printing is interrupted, roller cleaning processing is performed, and a print mode is changed to a print mode of a lesser ink applying amount, whereby it becomes possible to prevent reoccurrence of the roller transfer and sheet stain due to the roller transfer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-148157, filed Jul. 4, 2011, which is hereby incorporated by reference herein in its entirety.

What is claimed is:

1. An apparatus comprising:

a printing unit configured to eject ink from a print head onto a sheet conveyed in a direction to perform printing on the sheet;

a conveying unit including a rotating member in contact with the sheet configured to be provided at a downstream side of said print head in the direction; and a reading unit configured to read the sheet at a downstream side of said rotating member in the direction, wherein information on ink adhesion on said rotating member is obtained based on a result read by said reading unit.

2. The apparatus according to claim 1, wherein the information is obtained based on a result of reading, by said reading unit, a region of the sheet including a region away from a region where a pattern has been printed on the sheet by said printing unit to an upstream side in the direction by one circumferential length of said rotating member.

3. The apparatus according to claim 2, wherein the information is obtained through the use of an optical density of a surface of the sheet read by said reading unit, and a threshold value of an optical density set in response to the pattern.

4. The apparatus according to claim 1, wherein said apparatus further comprises a cutting unit configured to cut the sheet at a downstream side of a read position of said reading unit in the direction, and said cutting unit cuts the sheet based on a timing when the pattern is read by said reading unit.

5. The apparatus according to claim 1, wherein said apparatus further comprises a cutting unit configured to cut the sheet at a downstream side of a read position of said reading unit in the direction, said printing unit prints a cut mark for detecting a timing of cutting of the sheet at a position different from the pattern, and said cutting unit performs cutting of the sheet at a timing when the cut mark is read.

6. The apparatus according to claim 1, wherein an operation which prints a pattern to be read by said reading unit doubles as preliminary ejection for eliminating poor ejection of a nozzle.

7. The apparatus according to claim 1, wherein the apparatus further comprises a sorter unit arranged on a downstream side of said reading unit in the direction, and when ink transfer to said rotating member is detected based on the information, the apparatus interrupts printing of an image, and moves a printed matter which may have been stained to a disposal tray included in said sorter unit.

8. The apparatus according to claim 1, wherein the apparatus further comprises a cleaning unit configured to remove an ink stain having adhered to said rotating member, and when ink transfer to said rotating member is detected based on the information, said printing unit interrupts printing of an image, and said cleaning unit performs cleaning.

9. The apparatus according to claim 1, wherein the apparatus further comprises a setting unit for a print mode regarding an ink applying amount, and when ink transfer to said rotating member is detected based on the information, said setting unit changes a print mode to a print mode having a lesser ink applying amount.

10. A method comprising the steps of:

printing a pattern on a sheet; and reading the sheet on which the pattern has been transferred to obtain information on ink adhesion to a rotating member that conveys the sheet.

11. The method according to claim 10, wherein the surface of the sheet is read in a region including a region away from a region where the pattern of the sheet has been printed to an upstream side in a conveying direction by one circumferential length of the rotating member.

* * * * *